US006259374B1

(12) United States Patent
Kisner et al.

(10) Patent No.: US 6,259,374 B1
(45) Date of Patent: Jul. 10, 2001

(54) PASSIVE PAVEMENT-MOUNTED ACOUSTICAL LINGUISTIC DRIVE ALERT SYSTEM AND METHOD

(75) Inventors: Roger A. Kisner, Knoxville; Richard L. Anderson, Oak Ridge; Charles L. Carnal, Cookeville; James O. Hylton, Clinton; Samuel S. Stevens, Harriman, all of TN (US)

(73) Assignee: Lockheed Martin Energy Research Corporation, Oak Ridge, TN (US)

( * ) Notice: Subject to any disclaimer, the term of this patent is extended or adjusted under 35 U.S.C. 154(b) by 0 days.

(21) Appl. No.: 09/396,998

(22) Filed: Sep. 15, 1999

(51) Int. Cl.[7] ..... G08G 1/09

(52) U.S. Cl. ..... 340/905; 340/435; 340/437; 340/901

(58) Field of Search ..... 340/905, 901, 340/437, 435

(56) References Cited

U.S. PATENT DOCUMENTS 2,419,099 * 4/1947 Wall ..... 234/29.5
3,044,043 * 7/1962 Wendt ..... 234/29.5
4,490,069 * 12/1984 Cushman et al. ..... 404/15
4,790,684 * 12/1988 Adams ..... 404/16
5,392,728 * 2/1995 Speer et al. ..... 404/16
5,929,787 * 7/1999 Mee et al. ..... 340/907

* cited by examiner

*Primary Examiner*—Jeffery Hofsass
*Assistant Examiner*—Son M. Tang
(74) *Attorney, Agent, or Firm*—Fulbright & Jaworski

(57) ABSTRACT

Systems and methods are described for passive pavement-mounted acoustical alert of the occupants of a vehicle. A method of notifying a vehicle occupant includes providing a driving medium upon which a vehicle is to be driven; and texturing a portion of the driving medium such that the textured portion interacts with the vehicle to produce audible signals, the textured portion pattern such that a linguistic message is encoded into the audible signals. The systems and methods provide advantages because information can be conveyed to the occupants of the vehicle based on the location of the vehicle relative to the textured surface.

20 Claims, 6 Drawing Sheets

PASSIVE PAVEMENT-MOUNTED ACOUSTICAL LINGUISTIC DRIVE ALERT SYSTEM AND METHOD

STATEMENT AS TO RIGHTS TO INVENTIONS MADE UNDER FEDERALLY-SPONSORED RESEARCH AND DEVELOPMENT

This invention was made with Government support under contract No. DE-AC05-960R22464 awarded by the United States Department of Energy to Lockheed Martin Energy Research Corporation, and the Government has certain rights in this invention.

BACKGROUND OF THE INVENTION

1. Field of the Invention

The invention relates generally to the field of vehicle occupant notification systems. More particularly, the invention relates to driver notification systems having a road mounted component.

2. Discussion of the Related Art

Traveling on interstate highways requires a constantly high level of driver attention to reduce the risk of an accident. There are specific periods during which the opportunity for driver error and the potential for an accident is above average. Alerting the driver to the presence of hazardous conditions could reduce the risk or severity of an accident. Entering and exiting from interstate are especially hazardous periods, which require an alert and informed driver.

Run-off-the-road accidents are among the most frequent types of highway accidents. Tired, sleepy or inattentive drivers often fail to guide their vehicles within the proper lane, and almost every driver, on some occasion, has been distracted enough to run off the edge of the road onto the shoulder. A means is needed to warn such a driver of deviation from the intended path before the excursion becomes an accident.

Unfortunately, there are not enough reliable data on encroachment (the specific technical term used in highway safety literature to describe this type of incident) to allow highway engineers and others interested in highway safety to evaluate the frequency and severity of encroachments that do not result in accidents. The current state of the art of encroachment data collection has been described as "look for tire tracks." What is needed is a cost-effective way to collect sufficient data to allow evaluation or correction of existing situations that lead to encroachment and run-off-the-road accidents.

Accidents involving trains and automobiles are often tragic and fatal. Even though railroad crossings are clearly marked, many do not have flashing lights and audible tones because of the additional costs.

Safe driving rules and road signs are not adequate to prevent some classes of highway accidents. As we know, a moment's inattentiveness, distractions, and drowsiness can lead to accidents and fatalities. Other forms of sensory input such as bells at railroad crossings and rumble strips at dangerous intersections and sections of highway are used in special cases to supplement and complement visual symbols.

Most approaches to driver signaling require an on-board electronic device to detect and decode signals sent by road-side equipment. Legislation to require additional safety equipment for vehicles although often quite justified requires a significant effort and always adds to vehicle costs (e.g., air bags, seat belts, and center-mounted brake light).

SUMMARY OF THE INVENTION

This invention provides a method and apparatus for conveying specific messages in the form of words or other audible sounds to the driver and/or other occupants of vehicles, while traveling on a roadway. A modulation signal can be permanently embedded in the surface of the pavement. The modulation directly corresponds to spoken words, commands, or other audible messages. As the vehicle passes over the modulated region, the tires convey the sounds to the cabin of the vehicle. This conveyance requires no other apparatus on board the vehicle or along the highway. Thus, once the invention is installed, the method and apparatus can be passive. Conveying safety and other messages to vehicles passing by can reduce run-off-the-road accidents and alert drivers to other potentially hazardous conditions on interstate and secondary highways.

These, and other, goals and embodiments of the invention will be better appreciated and understood when considered in conjunction with the following description and the accompanying drawings. It should be understood, however, that the following description, while indicating preferred embodiments of the invention and numerous specific details thereof, is given by way of illustration and not of limitation. Many changes and modifications may be made within the scope of the invention without departing from the spirit thereof, and the invention includes all such modifications.

BRIEF DESCRIPTION OF THE DRAWINGS

A clear conception of the advantages and features constituting the invention, and of the components and operation of model systems provided with the invention, will become more readily apparent by referring to the exemplary, and therefore nonlimiting, embodiments illustrated in the drawings accompanying and forming a part of this specification, wherein like reference characters designate the same parts. It should be noted that the features illustrated in the drawings are not necessarily drawn to scale.

DESCRIPTION OF PREFERRED EMBODIMENTS

The invention and the various features and advantageous details thereof are explained more fully with reference to the nonlimiting embodiments that are illustrated in the accompanying drawings and detailed in the following description of preferred embodiments. Descriptions of well known components and processing techniques are omitted so as not to unnecessarily obscure the invention in detail.

Figure 1A:
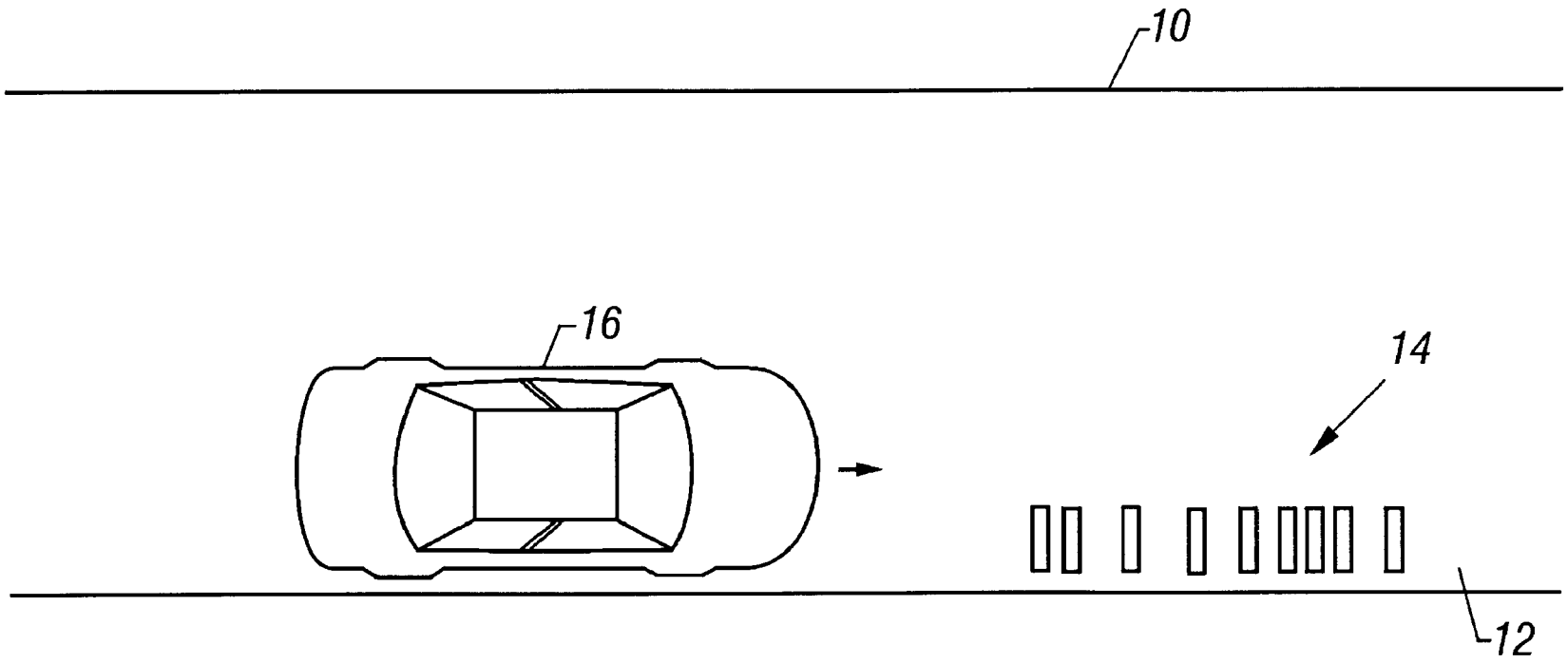
FIG. 1A is a topview of a vehicle approaching a textured portion of a driving medium, representing an embodiment of the invention.

The invention includes a vehicle occupant notification system. Referring to FIG. 1A, the system includes a driving medium having a driving side 12 with a textured portion 14 configured to be driven over by a vehicle 16. The textured portion 14 interacts with the vehicle 16 to produce audible signals. The textured portion 14 can embody a particular pattern which causes a message (e.g., linguistic message) to be included (encoded) in the audible signals. The linguistic message can represent human speech, which is heard by an occupant (e.g., driver) of the vehicle. Alternatively, the message can be received by a computer in the vehicle. The computer can decode the message and present it to the driver as a written or audible message containing words. Examples of linguistic or audible messages include, "pull left", "right turn ahead", "slow down", "bus stop seven", "work zone", etc.

Figure 1B:
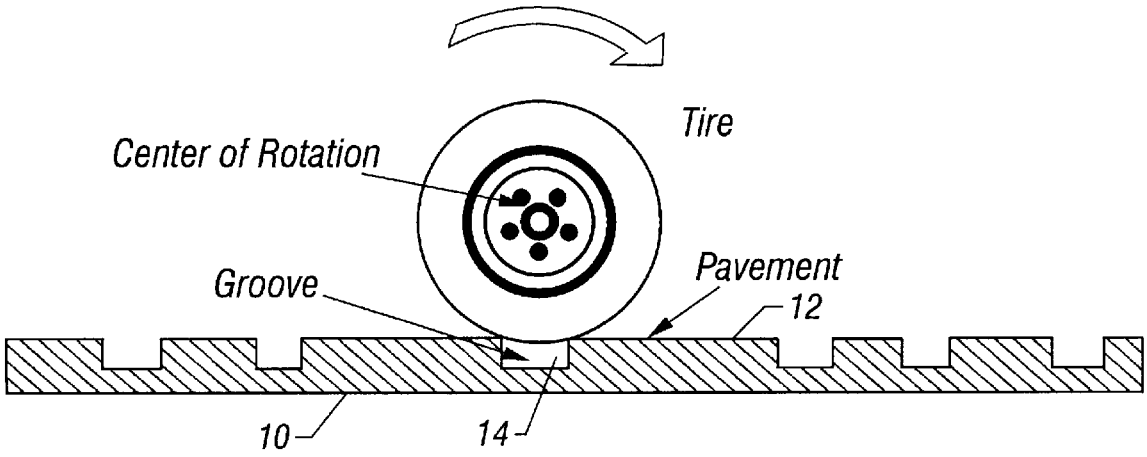
FIG. 1B is a sideview of a tire on a textured portion of a driving medium, representing an embodiment of the invention.

Referring to FIGS. 1A and 1B, the system includes a driving medium 10 having a textured portion 14. The textured portion 14 of the driving medium 10 is configured to be driven over by a vehicle which interacts with the textured portion 14 to produce audible signals. The textured portion 14 has a particular pattern which causes a linguistic message to be encoded into the audible signals. The linguistic message can be understood as speech by a driver of the vehicle.

The audible signals are generated within the vehicle cab by vibrations in the vehicle's interior imparted by small displacements of the vehicle wheels traveling over the textured portion 14 of the driving medium 10. The vehicle's suspension system generally does not significantly attenuate the signals, which are several octaves in frequency above road vibrations.

The invention also includes a method of driver notification. The method includes providing texture to a portion of a driving medium 10 such that when a vehicle is driven over the textured portion 14 audible signals are produced. The texture being patterned such that a linguistic message is encoded into the audible signals. The linguistic message can be understood as speech by a driver of the vehicle.

Examples of linguistic messages include, "pull left", "right turn ahead", "slow down", etc. Alternative linguistic messages could include intuitive warnings to get attention and elicit proper responses, and data about location, speed, and other attributes of an encroachment event.

A road is a particular example of a driving medium 10, which can have a textured portion 14 configured to encode a linguistic message. The textured portion 14 of the driving medium 10 can be positioned in an appropriate place to warn of the need to change vehicle speed or direction such as at interstate off-ramps and shoulders. Because the driver of a vehicle can receive the message without need of any apparatus on the vehicle or without external energy being supplied to the message sending device, the device can be termed passive.

An example of a textured portion 14 of a road is grooves cut into roads. Since highway departments are already grooving sections of roadway the costs of implementing the invention can be reduced.

Providing textured portions 14 of the road which have encoded linguistic messages can solve driver warning and data collection problems associated with cars being driven on roads. For instance, various linguistic messages can be encoded in the textured portions 14, where they would be reproduced by the interaction of the vehicle with the vehicle tires as they travel over the strips. The sounds can serve both to warn drivers and to facilitate the collection of quantitative encroachment data by high-tech microphones positioned along the road. These textured portions 14 can be positioned alongside the road and/or transverse to the direction of travel.

Additionally, the driving medium can be movable such as a portable flexible (e.g., rubber) rubber strip, which can be laid out on a highway or road. A suitable material for a portable driving medium 10 is a high-density, co-polymer, which can be rolled up or folded. The portable driving medium can also include a textured portion configured to encode a linguistic message. The portable driving medium can be rolled up and easily transported in an emergency vehicle to be used at an emergency site.

Suitable driving media include, but are not limited to, macadam, blacktop, cement and other materials which are driven over by vehicles. Suitable textured portions 14 are comprised of grooves, raised bumps, bumps and grooves, bumps within grooves, etc. The pattern, which causes the linguistic message to be encoded into the audible signals, results from varying the properties of the textured portion. For instance, when the textured portion includes grooves, the distance between the grooves can be varied, the size of the grooves can be varied, and/or the shape of the grooves can be varied. Similarly, when the textured portion includes bumps, the distance between the bumps can be varied, the size of the bumps can be varied, and/or the shape of the bumps can be varied.

The particular material used to provide texture to the driving surface should be wear resistant and inexpensive and is preferably resilient over a range of temperatures. For the manufacturing operation, it is an advantage to employ a concrete material. When the textured portion includes grooves, the grooves should be sloped and shaped so that water and debris would drain from them. Further, proper shaping of the texture portion would direct freezing expansion upwards, thus preventing cracking and disintegration of portions of the texture. To extend the lifetime of particular textures on a road, a mixture of cement, reinforcement material (e.g., fiberglass), and binders can be used.

Techniques for providing texture to the driving medium 10 include, but are not limited to, (1) cutting grooves into the driving medium 10 with a programmed machine, (2) factory-making a template to be impressed into the driving medium 10 when the driving medium 10 is in a soft state, (3) manufacturing a textured driving medium 10 and transporting it to a desired site.

As described above, the texture has a pattern that encodes a linguistic message. A variety of techniques are available for providing the pattern to the driving medium 10. for instance, when the driving medium 10 is soft, a computer-controlled machine can move over the portion of the driving medium 10 to be textured. The machine can include a movable bar, which moves to different depths in a driving medium 10. The bar can move up and down in a programmed pattern as the machine moves over the pavement. The programmed pattern is associated with the pattern to be provided to the textured portion 14.

An alternative technique for providing a patterned textured portion 14 to a driving surface is to provide a machine which positions fiber-reinforced cement bumps on the driving surface in the desired pattern. Preparation of the driving medium 10 would be required to ensure adhesion of the fiber-reinforced cement bumps.

The particular method for creating the pattern in the textured portion 14 of the driving surface is not essential to the invention as long as it provides the described functionality. Normally those who make or use the invention will select the manufacturing process based upon tooling and energy requirements, the expected application requirements of the final product, and the demands of the overall method.

The linguistic message to be encoded is selected based on the length of time required and the degree of intelligibility of the message required within the vehicle. A computer program could be used to process the signal before committing it to concrete to maximize intelligibility. Such processing would include frequency filtering, amplitude control, and wave envelope shaping. The message could range from a series of (pure) tones to several spoken words.

Mechanics of Sound Generation by Pavement Grooves

When the texture includes grooves in a driving medium 10, the grooves can cause generation of the audible signals as follows: As the tire rolls forward, it falls into the groove. The center of the tire's rotation (and thus the vehicle) drops a small amount, which lowers the potential energy. As the tire continues forward and out of the groove, the kinetic energy of forward motion is converted back to potential energy and the center of rotation moves up again. Thus, the groove converts the energy of forward motion into vertical motion. See FIG. 1. The same treatment would apply to bumps on the pavement.

Figure 2:
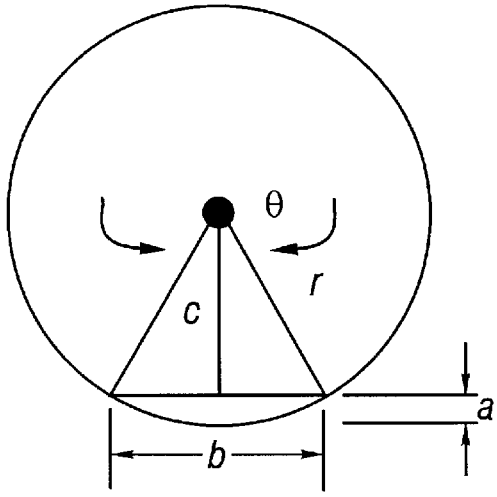
FIG. 2 illustrates a chord length diagram, representing an embodiment of the invention.

A simple model for the tire rolling across pavement grooves gives a general understanding of the dynamics at work. The vertical displacement of the tire's center of motion due to rolling into the groove can be calculated with trigonometry as seen in FIG. 2. The tire's vertical displacement a can be expressed as a function of groove width b as follows:

$$a=r-c \qquad \text{Equation (1)}$$

$$c=\sqrt{r^2-\left(\frac{b}{2}\right)^2} \qquad \text{Equation (2)}$$

$$a=r-\sqrt{r^2-\left(\frac{b}{2}\right)^2} \qquad \text{Equation (3)}$$

Figure 3:
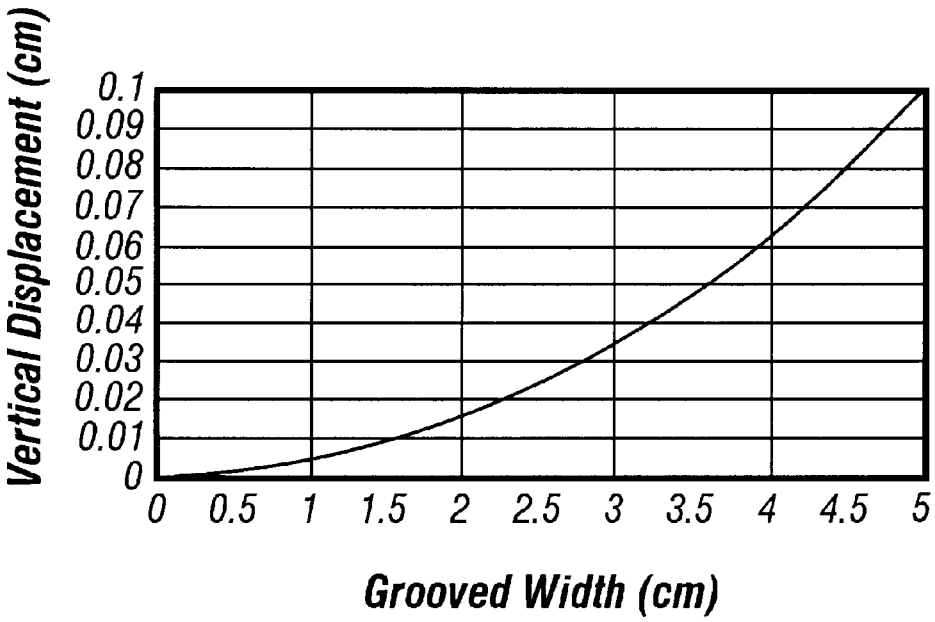
FIG. 3 illustrates the relationship of groove width to tire displacement, representing an embodiment of the invention.
Figure 4:
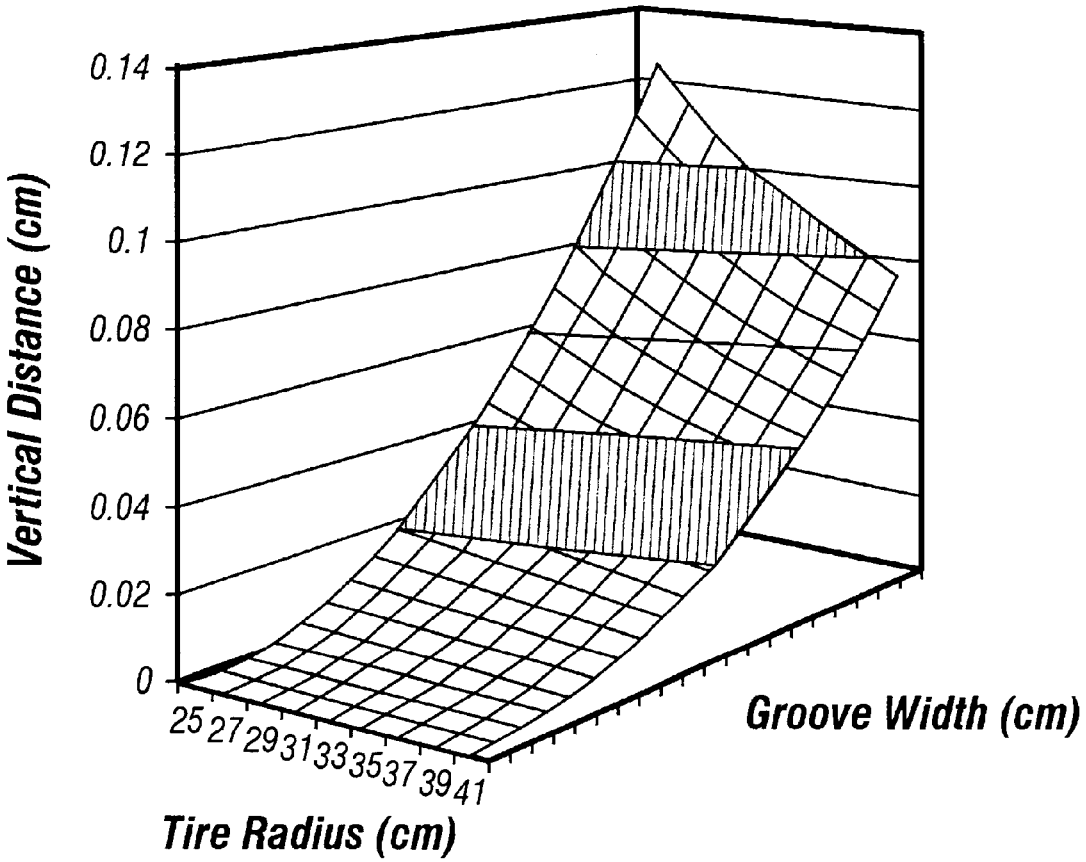
FIG. 4 illustrates a contour plot showing vertical movement as a function of tire radius and groove width, representing an embodiment of the invention.

For a typical tire diameter of 24 inches, r=12 inches. Assuming a pavement groove width of b=0.5", a vertical displacement is obtained of about 0.0026" (0.66 mm). This is a small movement. Vertical displacement of the center of rotation is nonlinearly sensitive to groove width as shown in FIG. 3, which is a plot of Equation (3). The surface contour of FIG. 4 shows the effect of varying tire radius and groove width.

The situation is more complex than accounted for by this model. For example, the tire has elastic properties. Various mechanical resonances and vibrations are set up in the tire itself and coupled to the vehicle through the spring, shock absorber, support arms, and other mechanical linkages. Some of the sound reaches the cab through the air.

The energy to lift a car related to a single pavement groove can be calculated from $$E_g=\int mg\,dy=mgy, \qquad \text{Equation (4)}$$

where g=9.81 m/s$^2$, m is the effective mass, and y is the vertical displacement of the tire's center of motion. For a vehicle of 1000 kg, we assume the mass is evenly distributed (i.e., 250 kg per tire). The groove energy per tire becomes $$E_g=(250\text{ kg})(9.81\text{ m/s}^2)(66\times10^{-6}\text{ m})=0.16\text{ J}. \qquad \text{Equation (5)}$$

At 60 mph (96.6 km/h) with 0.5 inch (1.27 cm) grooves spaced at 1.0 inch (2.54 cm) intervals, the delivered power to vertically displace each tire becomes about 170 watts. A small portion of this substantial mechanical power will be converted into acoustic power in the cab.

Studies of vehicle rolling friction indicate that 1–5 HP is dissipated at approximately 60 mph. This amounts to about one HP per tire. This dissipation will vary with vehicle weight, road conditions, temperature, and tire-tread type. The vibrational energy associated with tires rolling over grooves would be of the same magnitude.

Modeling of Sound Generation

Data were collected while driving an automobile on an interstate highway that had grooves cut at regular intervals in the shoulder zone. The recording apparatus used a small dynamic microphone and laptop computer with audio input. Sampling rates of 22 kHz and 44 kHz were used. Data were taken in a late model Chevrolet Cavalier at several speeds.

Data was obtained from a 1994 four-door Chevrolet Cavalier as described earlier driving on interstate highway at several speeds: 20 mph (32.2 km/h), 40 mph (64.4 km/h), 60 mph (96.6 km/h), and 70 mph (113 km/h). Interior sounds were picked up by a dynamic microphone and recorded digitally by a laptop computer running Windows. The resulting ".wave" files were processed in Matlab™ to identify the system.

Figure 5:
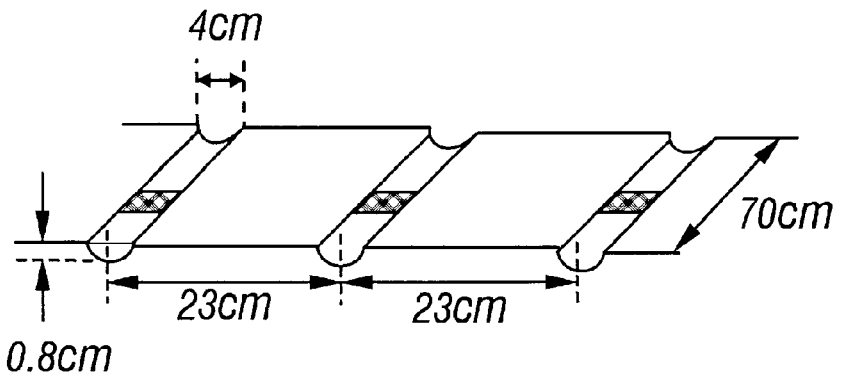
FIG. 5 illustrates a rumble strip groove pattern r recorded for data analysis, representing an embodiment of the invention.

The shoulder of interstate was grooved in a regular pattern that generated a distinct audible tone in the cab. The groove pattern was a 4 cm groove width spaced at 23 cm intervals as shown in FIG. 5 below. This pattern generated about a 117 Hz fundamental at 60 mph. Spectral analysis showed second and third harmonics. Higher harmonics were buried in the high ambient noise.

A transfer function was developed for the automobile based on comparing the observed road pattern in FIG. 5 with the acoustic signals recorded in the vehicle cab. We used a linear system identification procedure thus ignoring the non-linearity that lead to harmonic generation. The transfer function between the groove pattern on the road and the recorded sound was $$H(z)=\frac{Y(z)}{U(z)}=\frac{b}{1+a_1z^{-1}+a_2z^{-2}}, \qquad \text{Equation (6)}$$

where b=1, $a_1$=−1.8006, and $a_2$=0.8102.

Figure 6:
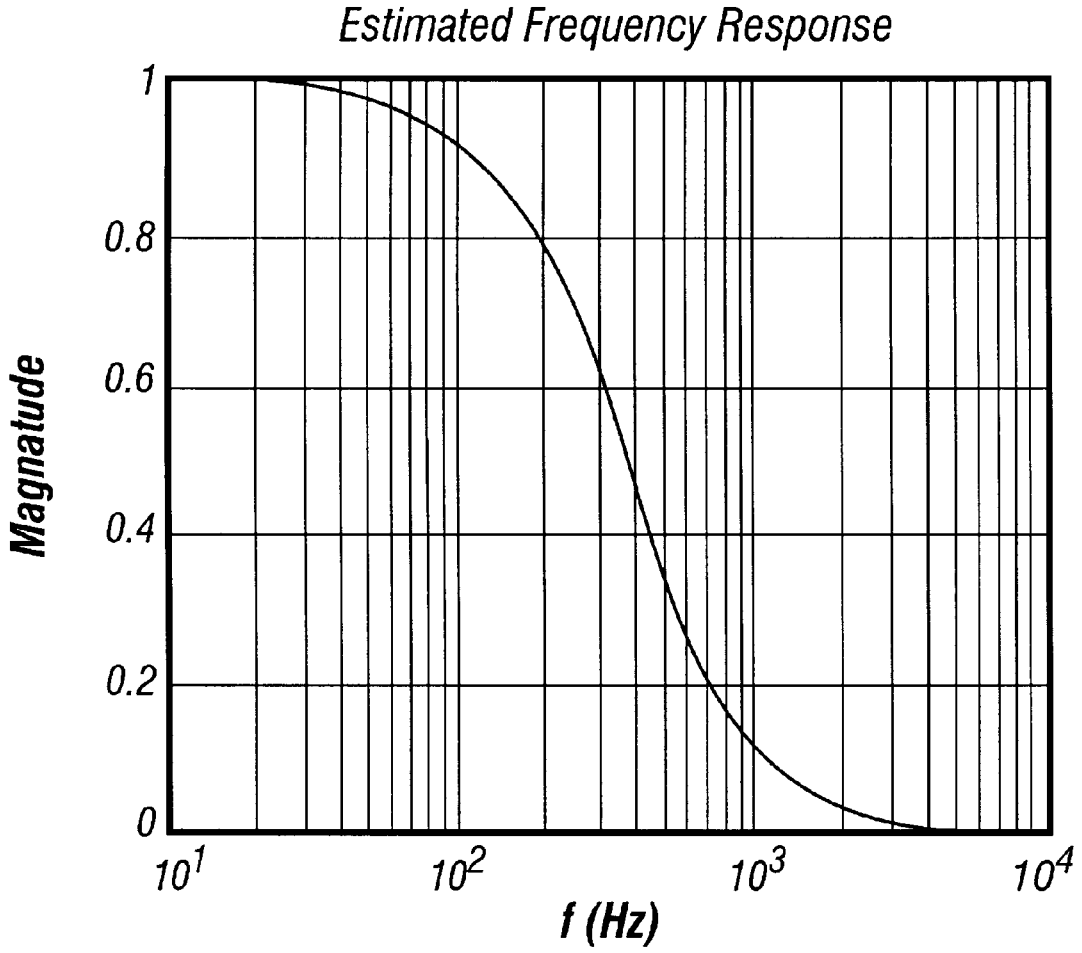
FIG. 6 illustrates a frequency response of the estimated vehicle transfer function, representing an embodiment of the invention.

The transfer function is a multi-pole low-pass filter with roll-off at 300 Hz (3 db down point). At 1 kHz, the magnitude of the frequency response is down by a factor of ten. This response is shown in FIG. 6. The filter response will vary between vehicles. Luxury vehicles will likely exhibit more acoustic attenuation and perhaps lower corner frequencies as compared with sports cars and sport utility vehicles.

The vehicle's transfer function is useful both in simulating the sounds of a tire running along a section of grooved pavement and for pre-emphasizing a signal that is desired to be placed as a pattern for the texture on a driving medium

Creation of a Pattern for the Texture on the Driving Surface

The above analysis indicates that a vehicle can produce audible signals, which are more complex than the fixed period (single tone) groove patterns cut into pavements today. The complex patterns could reproduce either multiple alert tones or human voice. An analog approach can be used to provide a patterned texture which captures every nuance of a linguistic message.

An alternative approach is to "digitize" the signal. A digitized signal can be produced with a sequence of fixed depth grooves, which may require less expensive cutting equipment and be more robust to wear and weather. An extreme form of dynamic compression can be used to compress a linguistic message to be encoded into a digital groove pattern. Dynamic compression in audio applications is the process of decreasing the magnitude of large amplitude signals and increasing the magnitude of small amplitude signals. Dynamic compression is applied in television commercials to capture a viewer's attention—large amounts of compression can make the sound seem louder even though the peak amplitude remains the same. The dynamic compression utilized in conjunction with the invention can be even more extreme since all signal amplitudes become one level. First the linguistic message signal is low-pass filtered to reduce noise and reduce the energy bandwidth in anticipation of the limited bandwidth that can be achieved with grooved pavement. Second, the filtered signal is processed by a threshold detector that produces a +1 output value when the input amplitude is above the threshold and a −1 value during the period the signal is below the threshold. The value of the threshold is set just above the ambient noise floor to maximize intelligibility and minimize noise. This extreme compression method preserves the frequency but eliminates the amplitude information.

Figure 7:
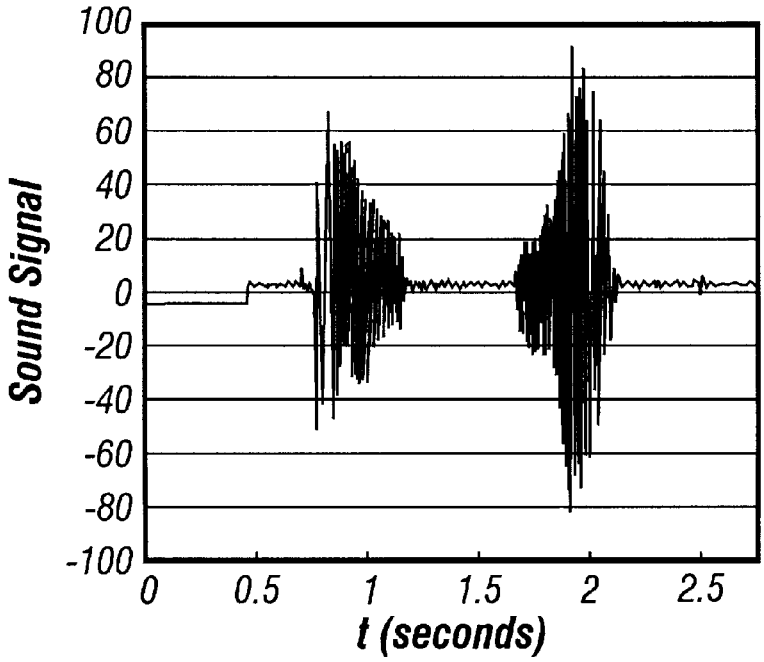
FIG. 7 illustrates a voice recording of expression "Pull Left", representing an embodiment of the invention.

The original signal of the expression "Pull Left" was captured using a dynamic microphone and a laptop computer. The unfiltered analog signal is shown in FIG. 7.

The raw signal was filtered using a second-order low-pass filter with a corner frequency of about 1 kHz. The filtered signal was dynamically compressed as described above. This digitized signal would then become the groove pattern to be cut into the road pavement. Finally, to verify that the digital groove pattern would reproduce in the cab of the automobile, we passed it through the experimentally determined transfer function. This sequence of steps is shown graphically in the signal plots of FIG. 8.

Figure 9:
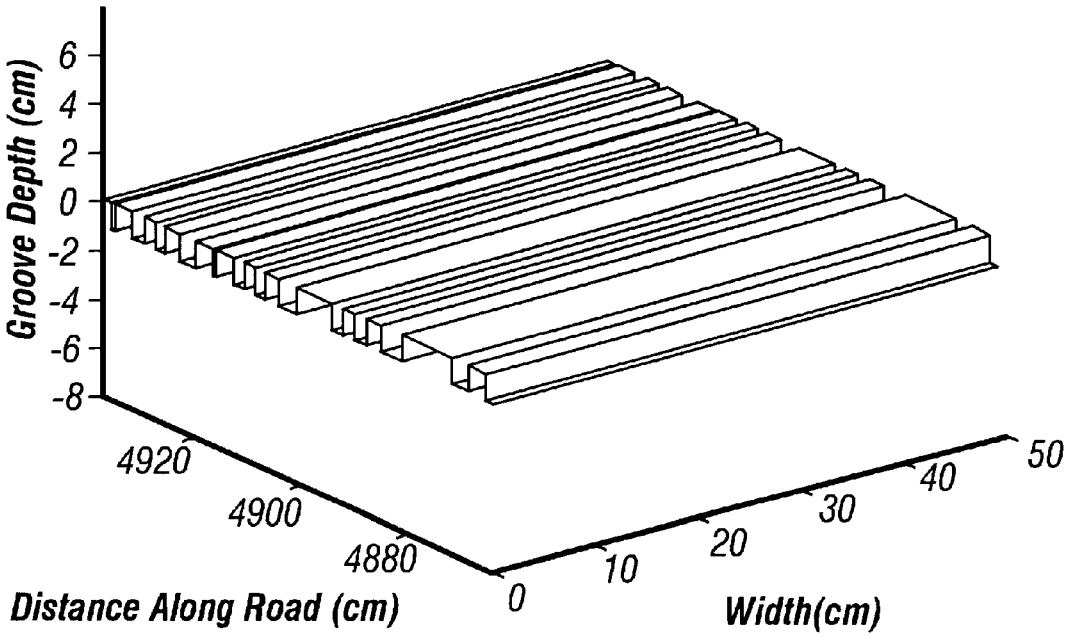
FIG. 9 illustrates a segment of pavement groove pattern shown in three dimensions, representing an embodiment of the invention.
Figure 8A:
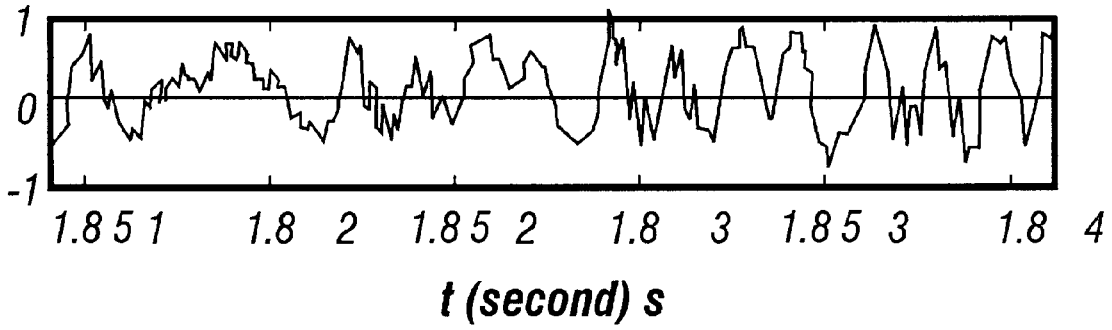
FIG. 8 illustrates a segment of signal showing steps going from a raw voice signal to a simulated sound in automobile cab, representing an embodiment of the invention.
Figure 8B:
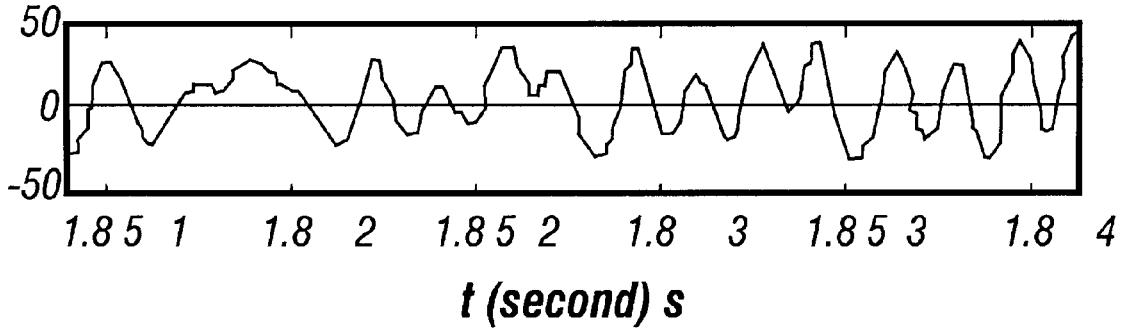
Figure 8C:
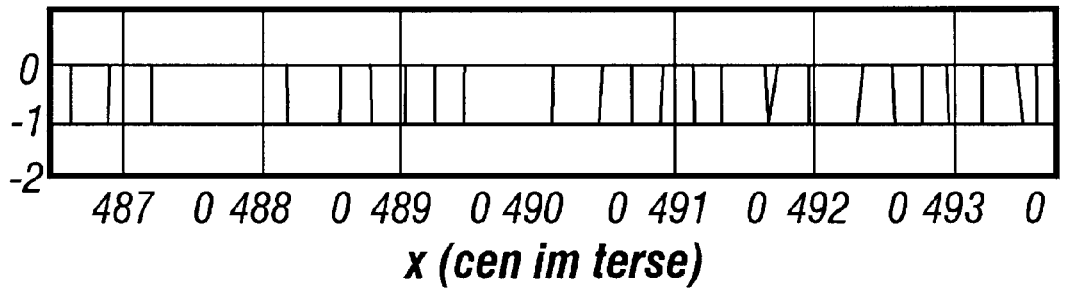
Figure 8D:
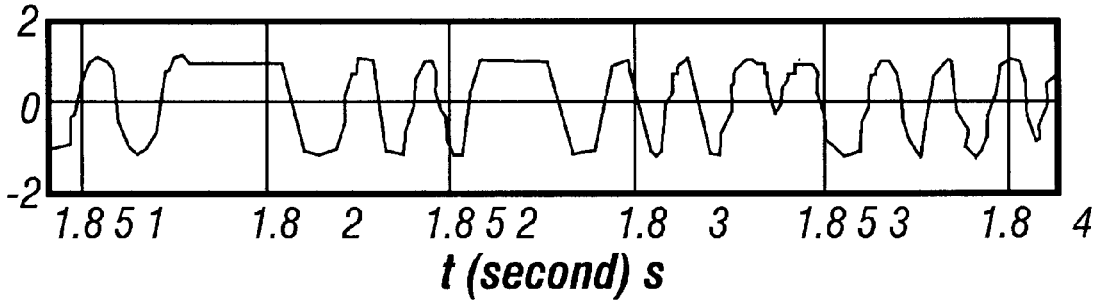

The groove pattern can be displayed in three-dimensions as it would look to an observer standing on the pavement. This view is shown in FIG. 9. The visual appearance is not much different than the regular spacing of grooves currently used on some interstate shoulders.

Industry standards will need to be imposed on the groove generation process that places minimums on groove size and limits on spacing. These limits are needed to prevent overly complex and expensive fabrication and to prevent fabrication of pavement features that are easily worn down such as a single narrow ridge placed (unsupported) in a wide valley. In most cases, such limits will not adversely affect the sound of the playback. For example, a limit on groove spacing might include no groove can be less than 1 cm.

When the physical profile of structure for imparting the vibratory motion is excessively low, the amplitude of imparted vibratory motion may be excessively low. On the other hand, when the structure for imparting the vibratory motion is excessively high, the wear rate of the vibratory structure may be unacceptably rapid, particularly on busy roads with heavily laden trucks.

There are other methods that could potentially yield better digitization results based on the observation that the amplitude of the audio signal increases with groove width as seen in FIG. 3. This effect results from the tire's surface contour being much wider than pavement grooves; therefore, the tire does not follow through and touch the bottom of the valleys.

The signals from FIG. 8 were auditioned by several researchers by playing them back over the speaker system of a typical computer. Although a subjective measure, the message "pull left" was clearly discerned. Good intelligibility can be obtained using an actual vehicle.

While not being limited to any particular performance indicator or diagnostic identifier, preferred embodiments of the invention can be identified one at a time by testing for the presence of intelligible auditory messages. The test for the presence of intelligible auditory messages can be carried out without undue experimentation by the use of a simple listener experiment. Another way to seek embodiments having the attribute of intelligible auditory messages is to simulate the generated acoustic signal by computer modeling and compare the simulated signal to stored waveforms.

Factors Governing Word Choices

The clarity and articulation of the speaker will have a direct impact on the intelligibility of the final pavement-produced message. Production voice-over men and women are regularly used in radio and television announcing. These production voices are chosen for articulation, control, and general mass appeal. Further, their voices are electronically processed with equalization, volume compression, "de-essing," and other electronic effects to enhance and maximize impact and clarity. Regional dialect is also taken into account for selection of voices in radio and television. Choice of human voice and use of effects will be a part of creating pavement utterance.

We discovered that in speeding the playback intelligibility seemed to improve slightly for the voice and word choice made. Human perception seems to permit a little more intelligibility when speeding up the sound than in slowing playback. Overall, there seems to be about ±25 percent speed variation allowed before intelligibility difficulty. As a result, intelligibility of the linguistic message can likely be achieved over a range of approximately ±25 percent variation in vehicle speeds. This percentage for example translates to a range of 45 to 75 mph. A wider range may be possible for select words.

For widespread highway alert applications, there will need to be a limited selection of words and phrases. Some of the selection factors will include word and phrase length (1 sec. translates to over 100 ft.), frequency content (fricatives and vowels), and textual ambiguity (dialect and language). It may be that certain words become standardized in pavement playback across a region or the country.

Long messages may have to be inscribed into pavements to give ample warning of an upcoming change or as a continuous message along the shoulder. However, for economy's sake the longer message may be constructed by concatenation of short repeated messages. Pavement messages take considerable length due to the distance traveled at high speeds. As an example a four-second message at 60 mph requires 352 feet of grooved pavement.

Encoding for Active On-Board System

As an alternative to a linguistic message, which is heard as speech by the driver of the vehicle, the linguistic message can also be decoded by an on-board system that includes logic for translating the audible signals to the linguistic message. The system can then present the linguistic message to the driver in a written form on a display such as an LED display (i.e. led) or in an audible form over a speaker. This approach may be less desirable because of the initial expense, maintenance, and reliability problems of an electronic apparatus. A vehicle would have to be equipped with a receiver-decoder to "read" the road signals. The positive benefit, however, is that a wider variety of messages compared with the passive approach may be placed on the road. Additionally, the size of the textured portion 14 associated with a particular message can also be reduced. Further, the playback mechanism in the cab would be highly intelligible including the ability to select from a database of several languages.

Practical Applications of the Invention

Several applications are envisioned for the passive pavement-mounted driver alert: fixed and movable. Fixed safety applications are for long-term installation in roadways. Examples include shoulder encroachment warning, warning of approach to entrance-exit ramps, railroad crossings, congestion areas, emergency vehicle entrances, intersections, curves, and rock slide areas. Fixed information applications can include welcome messages for city-county-state boarders; entertainment and theme parks; hospital, park, school zones; airports and animal crossings.

Movable applications are for short-term and movable uses. Examples include use as a roll-out mat by emergency vehicles, road work crews, construction zones, and temporary hazards. Movable information applications include federal, state, county, and city highways as well as private (corporate) roadways.

Use in foreign countries will provide an international market. Some languages such as Japanese may even be more intelligible than English because of their consonant and vowel structures.

The U.S. Department of Transportation can use the invention in permanent acoustical alert devices on interstate highways to reduce the number of accidents at on-ramps, off-ramps, merge areas, bridges, and shoulders. Temporary warning devices can be installed during construction. Portable devices can be used at the scene of accidents and hazardous spills. There are virtually innumerable uses for the invention, all of which need not be detailed here.

Advantages of the Invention

A driving surface having textured portion with an encoded pattern representing an embodiment of the invention, can be cost effective and advantageous for at least the following reasons. The invention warns motorists of potentially hazardous conditions at a specific location. The invention does not require equipment on-board the vehicle. The invention can be permanently installed on highways (low maintenance). The invention requires no electronic parts to fail or replace at the installation. The invention is based on audible sound so that impaired visibility of highway signs (e.g., night, fog, snow) is not a consideration. The invention provides a significant advantage since sound may be a greater attention-getter than vision for a driver who may be falling asleep.

The disclosed embodiments show a rectilinear groove as the texture, which imparts the vibratory motion to the vehicle, but the structure for imparting this motion can be any other structure capable of performing the function of imparting vibratory motion, including, by way of example a substantially V-shaped or concave (e.g., partially hyperbolic) groove, or a substantially V-shaped or convex (e.g., parabolic) bum. The structure for imparting the vibratory motion to the vehicle can be any shape, form or structure.

The term "approximately", as used herein, is defined as at least close to a given value (e.g., preferably within 10% of, more preerably within 1% of, and most preferably within 0.1% of). The term "substantially", as used herein, is defined as at least approaching a given state (e.g., preferably within 10% of, more preferably within 1% of, and most preferably within 0.1% of). The term "coupled", as used herein, is defined as connected, although not necessarily directly, and not necessarily mechanically. The terms "programed" and "programmable", as used herein, are defined as controlled, or capable of being controlled, at least in part, by two or more lines of code that can be executed by a computer.

All the disclosed embodiments of the invention described herein can be realized and practiced without undue experimentation. Although the best mode of carrying out the invention contemplated by the inventors is disclosed above, practice of the invention is not limited thereto. Accordingly, it will be appreciated by those skilled in the art that the invention may be practiced otherwise than as specifically described herein.

For example, the individual components need not be formed in the disclosed shapes, or assembled in the disclosed configuration, but could be provided in virtually any shape, and assembled in virtually any configuration. Further, the individual components need not be fabricated from the disclosed materials, but could be fabricated from virtually any suitable materials. Further, although the vehicle occupant notification system described herein can be a physically separate module, it will be manifest that the vehicle occupant notification system may be integrated into the vehicle pathway with which it is associated. Furthermore, all the disclosed elements and features of each disclosed embodiment can be combined with, or substituted for, the disclosed elements and features of every other disclosed embodiment except where such elements or features are mutually exclusive.

It will be manifest that various additions, modifications and rearrangements of the features of the invention may be made without deviating from the spirit and scope of the underlying inventive concept. It is intended that the scope of the invention as defined by the appended claims and their equivalents cover all such additions, modifications, and rearrangements. The appended claims are not to be interpreted as including means-plus-function limitations, unless such a limitation is explicitly recited in a given claim using the phrase "means-for." Expedient embodiments of the invention are differentiated by the appended subclaims.

What is claimed is:

1. A vehicle occupant acoustical linguistic notification system, comprising:

a driving medium having a textured portion which interacts with the vehicle to acoustically produce audible signals, the textured portion having a pattern which causes a linguistic message to be acoustically encoded into the audible signals, wherein the linguistic message encoded into the audible signals can be understood as speech by a driver of the vehicle.

2. The vehicle occupant notification system of claim 1, wherein the driving medium is a roadway.

3. The vehicle occupant notification system of claim 1, wherein the driving medium is portable.

4. The vehicle occupant notification system of claim 1, wherein the textured portion includes a plurality of grooves.

5. The vehicle occupant notification system of claim 1, wherein the textured portion includes a plurality of bumps.

6. The vehicle occupant notification system of claim 1, wherein the driving medium is manufactured from a mixture of cement, reinforcement material and binders.

7. The vehicle occupant notification system of claim 6, wherein the reinforcement material includes fiberglass.

8. The vehicle occupant notification system of claim 1, further comprising:

an on board vehicle subsystem including logic for translating the audible signals to the linguistic message.

9. The vehicle occupant notification system of claim 8, wherein the on board vehicle subsystem includes a display for displaying the linguistic message to a driver of the vehicle.

10. The vehicle occupant notification system of claim 8, wherein the on board vehicle subsystem includes a speaker for pronouncing the linguistic message to a driver of the vehicle.

11. The vehicle occupant notification system of claim 1, wherein the textured portion is sufficiently rough to provide audible signals which can be heard within a cab of the vehicle.

12. The vehicle occupant notification system of claim 1, wherein the driving medium includes at least one resin and at least one filler selected from the group of metals and ceramics.

13. The vehicle occupant notification system of claim 1, wherein the driving medium includes a polymer-based mat that is applied to a surface of a roadway.

14. A method of acoustically linguistically notifying a vehicle occupant, comprising:

providing a driving medium upon which a vehicle is to be driven; and texturing a portion of the driving medium such that the textured portion interacts with the vehicle to acoustically produce audible signals, the textured portion patterned such that a linguistic message is acoustically encoded into the audible signals, wherein the linguistic message encoded into the audible signals can be understood as speech by a driver of the vehicle.

15. The method of claim 14, wherein providing a driving medium includes paving a road.

16. The method of claim 14, wherein providing a driving medium includes forming a portable strip configured to be driven upon.

17. The method of claim 14, wherein texturing a portion of the driving medium includes providing a plurality of grooves in the driving medium.

18. The method of claim 17, wherein the linguistic message results from providing a variable distance between the grooves.

19. The method of claim 17, wherein the linguistic message results from providing a variable distance between the bumps.

20. The method of claim 14, texturing a portion of the driving medium includes providing a plurality of bumps on the driving medium.

* * * * *

UNITED STATES PATENT AND TRADEMARK OFFICE

CERTIFICATE OF CORRECTION

PATENT NO. : 6,259,374 B1
DATED : July 10, 2001
INVENTOR(S) : Roger A. Kisner; Richard L. Anderson; Charles L. Carnal; James O. Hylton; and Samuel S. Stevens It is certified that error appears in the above-identified patent and that said Letters Patent is hereby corrected as shown below:

Title page,
Item [54], delete "Drive" and substitute therefor -- Driver --.

Signed and Sealed this

Twenty-ninth Day of January, 2002

*Attest:*

*Attesting Officer*

JAMES E. ROGAN
*Director of the United States Patent and Trademark Office*